US007481234B1

(12) United States Patent
Gustafson et al.

(10) Patent No.: US 7,481,234 B1
(45) Date of Patent: Jan. 27, 2009

(54) BIO-HAZARD ATTACK FAMILY SURVIVAL DOME

(76) Inventors: Martin K. Gustafson, 5760 SW. 40th Ave., Fort Lauderdale, FL (US) 33314; David E. Flinchbaugh, 4855 Big Oaks La., Orlando, FL (US) 32806-7826; Douglas W. Dittmann, 1010 Bucksaw Pl., Longwood, FL (US) 32750; Martin Gozdenovich, 275 W. Mountain Rd., Sparta, NJ (US) 07871; D. Michael Epley, 1041 NE. 204 La., North Miami, FL (US) 33179

( * ) Notice: Subject to any disclaimer, the term of this patent is extended or adjusted under 35 U.S.C. 154(b) by 85 days.

(21) Appl. No.: 10/811,595

(22) Filed: Mar. 29, 2004

Related U.S. Application Data

(60) Provisional application No. 60/507,850, filed on Sep. 30, 2003, provisional application No. 60/458,923, filed on Mar. 27, 2003.

(51) Int. Cl.
*E04H 15/10* (2006.01)

(52) U.S. Cl. ..... 135/91; 135/96; 135/156

(58) Field of Classification Search ..... 135/156, 135/114–117, 906, 124, 128, 136, 141, 96, 135/91; 55/385.1–385.2, 486; 52/1, 3
See application file for complete search history.

(56) References Cited

U.S. PATENT DOCUMENTS 2,297,150 A * 9/1942 Hunter ..... 135/906
3,119,358 A * 1/1964 Colson ..... 135/117
3,213,868 A * 10/1965 Forbes ..... 135/116
3,272,199 A * 9/1966 Matthews ..... 135/117
3,547,136 A * 12/1970 Prinz ..... 135/156
4,099,656 A 7/1978 Neumann et al. ..... 294/157
4,185,972 A 1/1980 Nitta et al. ..... 96/99
4,244,710 A * 1/1981 Burger ..... 95/69
4,590,956 A 5/1986 Griesenbeck ..... 135/116
4,625,468 A * 12/1986 Hampel ..... 135/115

(Continued)

FOREIGN PATENT DOCUMENTS

EP 0075483 A1 * 3/1983

*Primary Examiner*—Winnie Yip
(74) *Attorney, Agent, or Firm*—Brian S. Steinberger; Law Offices of Brian S. Steinberger, P.A.

(57) ABSTRACT

A family protective shelter which can be erected quickly inside in a home living room, family room, patio, or on an outside lawn area. This dome tent enclosure is designed of clear plastic sheet material which is impervious to gases used to conduct chemical warfare (such as nerve gas, mustard gas, serin, cyanide, and the like) dispersed biohazard aerosol compounds (such as anthrax, smallpox, polio, bacteria, viruses, or fungi), or other atmospheric toxins, such as those from a nuclear fallout. This protective "pop-up", external frame enclosure will be sized to house at least two adults comfortably (6×9×7 high inside, up to about 10×18'×7' high), will incorporate a zip-lock entrance/egress isolation portal chamber, and will communicate to the outside world through combat gas mask filters, plus phone, computer and electrical outlet feed-through, and perhaps a water trap coupling. The invention can keep a family of 1 to 10 (with a larger size) relatively isolated and safe from the harmful effects of a chemical biohazard, or nuclear fallout enemy attack for a matter of hours up to several days. The portal chamber can also connect together additional modules.

13 Claims, 4 Drawing Sheets

U.S. PATENT DOCUMENTS 4,626,265 A * 12/1986 Adiletta ..... 96/135
4,641,400 A 2/1987 Moreland ..... 24/389
4,707,953 A * 11/1987 Anderson et al. ..... 52/63
4,852,598 A 8/1989 Griesenbeck ..... 135/137
5,004,483 A * 4/1991 Eller et al. ..... 95/10
5,140,980 A * 8/1992 Haughey et al. ..... 128/201.25
5,185,015 A * 2/1993 Searle ..... 96/16
5,190,659 A * 3/1993 Wang et al. ..... 210/663
5,479,744 A * 1/1996 Meyer ..... 135/124
5,537,784 A * 7/1996 Baldwin ..... 52/2.17
5,628,336 A * 5/1997 Lee ..... 135/114
5,688,297 A 11/1997 Spengler ..... 55/356
5,706,846 A * 1/1998 Sutton ..... 135/128
5,845,504 A * 12/1998 LeBleu ..... 62/92
5,913,322 A * 6/1999 Gallant et al. ..... 135/124
5,964,222 A 10/1999 Kotliar ..... 128/205.26
5,997,619 A * 12/1999 Knuth et al. ..... 96/224
6,001,057 A * 12/1999 Bongiovanni et al. ..... 600/21
6,192,633 B1 * 2/2001 Hilbert ..... 52/2.18
6,321,764 B1 * 11/2001 Gauger et al. ..... 135/128
6,390,110 B1 * 5/2002 Brown ..... 135/93
6,402,613 B1 * 6/2002 Teagle ..... 454/195
6,508,850 B1 1/2003 Kotliar ..... 55/385.2
6,554,013 B2 * 4/2003 Brown ..... 135/156
6,652,943 B2 11/2003 Tukachinsky et al. .... 428/36.91
6,666,910 B2 12/2003 Burkhart ..... 95/286
6,875,119 B2 * 4/2005 Murphy et al. ..... 52/2.13
6,892,742 B2 * 5/2005 Wang ..... 135/115
2002/0020439 A1 * 2/2002 Tate ..... 135/124
2004/0060589 A1 * 4/2004 Torres-Badash ..... 135/156
2004/0074529 A1 * 4/2004 Levy et al. ..... 135/93

* cited by examiner

BIO-HAZARD ATTACK FAMILY SURVIVAL DOME

This invention claims the benefit of priority to U.S. Provisional Patent Applications 60/458,923 filed Mar. 27, 2003; and 60/507,850 filed Sep. 30, 2003.

FIELD OF USE

This invention relates to temporary shelters, in particular to an easy and quick to assemble sealable tent enclosure structures having air filters for use as a safe environment from emergency conditions such as those occurring during biohazard and chemical warfare and nuclear fallout emergencies.

BACKGROUND AND PRIOR ART

In the last several years Americans have been threatened with potential chemical and biological attacks. Airborne toxic agents such as nerve gas, mustard gas, serin, cyanide, etc.) dispersed biohazard aerosol compounds (such as anthrax, smallpox, polio, bacteria, viruses, or fungi), or other atmospheric toxins, are now a real threat to the average citizen.

After the Sep. 11, 2001, disaster, it became popular to purchase plastic sheets and duct tape as a potential safeguard against the dangerous airborne toxins that would come with such attacks. The time frame between the attacks and possible contagion has been estimated to be as low as 15-20 minutes. However, using duct tape and plastic sheets would not offer a quick solution to preventing contagions since using duct tape and plastic sheets could take most of and potentially more than the time it takes for contagions to arrive. Still furthermore, plastic sheeting and duct tapes are used to create a wall, and do little to prevent contaminated air from entering in through leaky windows and doors.

Over the years there have been various types of body suits such as HazMat (hazardous material) suits, and diving suits and the like. However, these suits are difficult and time consuming to wear. In addition, these suits are for protecting single persons and not two or more persons at one time.

Various enclosures have been proposed such as bed tents, and the like. See U.S. Pat. Nos. 4,590,956 and 4,852,598 to Griesenbeck; 5,688,297 to Spengler; and 6,508,850 to Kotliar. However, these enclosures are primarily directed toward protecting a single sleeping person that is in a horizontal position, and would not be useful for creating a livable and useable habitat enclosure. Also, these enclosures would not be able to seal against and be impervious to chemical and biological airborne agents and radioactive particles (from nuclear fallout) that can occur in a terrorism attack.

A larger enclosure is shown and described in U.S. Pat. No. 6,666,910 to Burkhart. However, this enclosure would appear to take potentially longer than the 15-20 minute time limit that would occur with an unexpected act of terrorism. This enclosure seems to be a modified version of using sheet plastic and duct tape that would not work. Also, the sheet material in Burkhart does not describe, teach, nor suggest how it would be able to seal against and be impervious to chemical and biological airborne agents and radioactive particles (from nuclear fallout) that can occur in a terrorism attack.

Thus, the need exists for solutions to the above problems with the prior art.

SUMMARY OF THE INVENTION

A primary objective of the present invention is to provide a protective tent enclosure and method of use as a temporary habitat for protection against all airborne biological and chemical toxins and nuclear fallout, that can be quickly deployed within approximately five minutes.

A secondary objective of the present invention is to provide a protective tent enclosure and method of use as a temporary habitat for protection against airborne biological and chemical toxins and nuclear fallout, that is self-contained, portable, and inexpensive.

A third objective of the present invention is to provide a protective tent enclosure and method of use as a temporary habitat for protection against airborne biological and chemical toxins and nuclear fallout, that can keep a family or group isolated and safe.

A fourth objective of the present invention is to provide a protective tent enclosure and method of use as a temporary habitat for protection against airborne biological and chemical toxins and nuclear fallout, that uses a multi-tiered and multi-phase filtration system for providing air to occupants of the enclosure.

A sixth objective of the present invention is to provide a protective tent enclosure and method of use as a temporary habitat for protection against airborne biological and chemical toxins and nuclear fallout, that can house anywhere from approximately one to approximately ten people.

Expandable enclosures and methods of assembling enclosures for anywhere from two to ten or more occupants. Flexible and foldable material such as a multilayer sheet material can be used to form a floor, walls, and roof portion of an enclosure that prevents contaminants from chemical, biological and nuclear accidents and terrorism attacks from entering into the enclosures.

The novel invention can go from a folded compact state to a fully assembled and occupant ready to be used state in less than approximately five minutes.

Features such as watertight and airtight sealable zipper type fasteners, positive and/or negative pressure causing blower fans, release valves, and the like, can also be used. Negative pressure can be used to filter air coming out of the enclosure.

A multi-stage filtration and blower can also be used for releasing air from the enclosure for quarantine purposes. A four phase filtration system can include a Nuclear rated HEPA (High Efficiency Particulate Air) cell, activated Carbon cell, microbial filter and electrostatic filter.

A multistage air filter can be used with the invention which assures that the breathing air inside the tent enclosure can pass certain tests for guaranteeing the personal safety from contaminated toxic or radiation hazard fallout which may be present in the outside air during or following a terrorist attack within our homeland. The uniqueness of this air filtration system lies in the design and functional configuration of a HEPA filter stage, a silver activated granular carbon filter stage, multiple permanent electrostatic grid/foam stages, expanded metal filter stages, microbial filter stages, and in the most sophisticated version, high-voltage plasma/ionic electrostatic filtration with an ultraviolet photochemical purification stage and negative ion dispersion.

The functional configuration described has application to both the enclosure controlled environment as well as to whole house indoor air quality control. The latter application would utilize similar components scaled up in size and packaging to fit into a typical household or commercial air handling system.

Further objects and advantages of this invention will be apparent from the following detailed description of the presently preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

Figure 1:
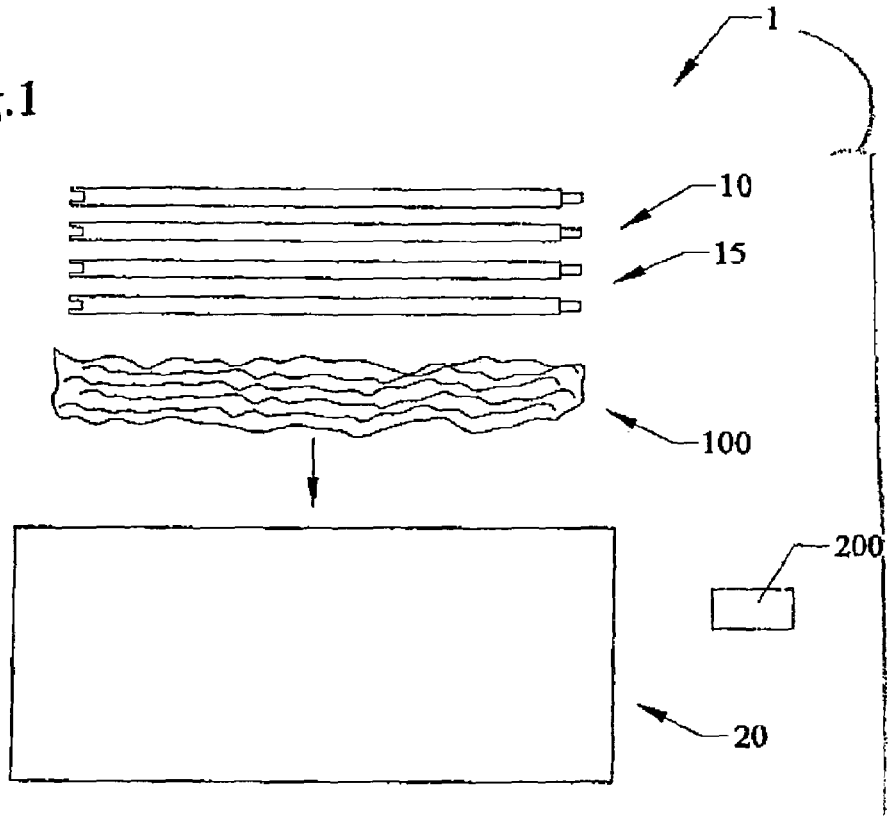
FIG. 1 shows a collapsed version of the support poles and folded enclosure of the invention that when disassembled can fit into a small carryable box.

FIG. 1 shows a collapsed version 1 of the two main support poles 10, 15 and folded enclosure 100 of the invention that when disassembled can fit into a small carryable box 20 that can have a size of approximately twenty seven inches by approximately twenty nine inches by approximately ten inches, and an overall weight of less than approximately forty five pounds. The preferred embodiment can use two poles that are formed by interconnecting separate smaller pole pieces together, which is described in reference to FIGS. 2A-2B.

The individual pole pieces can each be formed from tubular metal, spring steel, plastic, graphite, fiberglass, composite, and the like, similar to pole supports used in existing tents such as those manufactured by Coleman® and the like. For example, the invention can use similar bendable poles such as those shown and described in U.S. Pat. No. 4,590,956 which is incorporated by reference. The invention uses pole pieces that when assembled can create a rod shape that can flex but with a memory that tends to force the rod back into a straight rod configuration.

Figure 2A:
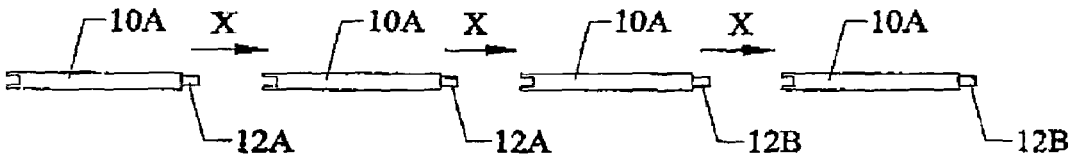
FIG. 2A is a side view of an embodiment using telescoping pole pieces for the enclosure.

FIG. 2A is a side view of an embodiment using telescoping pole pieces 10A for the enclosure. Here, a single pole can be assembled from four hollow cylindrical pole pieces 10A each having a narrow tip end 12A which telescoping is interconnected into a rear end of the next pole piece 10A as shown by arrows X.

Figure 2B:
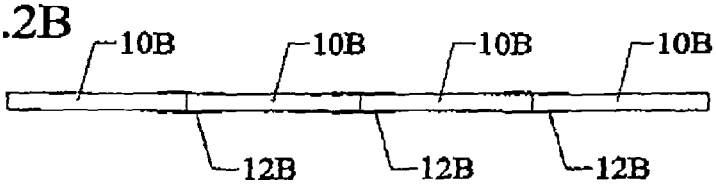
FIG. 2B is a side view of an embodiment using sleeve joined pole pieces for the enclosure.

FIG. 2B is a side view of an embodiment using sleeve joined pole pieces 10B for the enclosure. Similar to the preceding figure, four separate cylindrical pole pieces 10B can be joined end to end with one another by sleeves 12B which are only slightly larger in diameter than the pole pieces 10B.

As shown in FIG. 1, the enclosure 100 itself can be taken from a storage container 20 in a folded state. The enclosure 100 can have the unfolded shape of a dome type shape with walls and floor portion. The enclosure 100 can be formed by attaching separate multi-layers of sheet material together so that edges are sealed against one another preferably by RF (radio frequency) welding techniques and the like.

The multi-layered material used for enclosure 100 can be transparent and transparent to light in addition to being impervious against chemical and biological airborne agents.

Additionally, the multi-layered material used for enclosure 100 can be colored and/or dyed so as to be opaque to light while still being impervious against chemical and biological airborne agents.

The multi-layered sheet material used for forming the enclosure must be flexible and foldable, and impervious to biological and chemical agents, such as the multi-layered material labeled as Challenge X-22 and X-23, which is shown and described in U.S. Pat. No. 6,652,943 to Tukaschinsky et al., assigned to Saint-Gobain, which is incorporated by reference. A preferred embodiment of the subject invention can use a multi-layered material such as the Tukaschinsky patent that has a thermoplastic polymer layer in contract with a crosslinkable polymer layer to form an intercrosslinked multilayer polymer sheet material. The thermoplastic layer can include a thermo plastic polymer layer of a thermoplastic resin comprising polyolefins, polyamides, polyesters or fluoropolymer resins, and/or include a crosslinkable polymer such as polyamides, polyesters and their copolymers, and polyolefins including polyethylene.

The sheet material can be formed from multi-laminates, and include substances such as Polytetraflurethylene (also known as TEFLON®), and the like, as well as other materials that would be impervious to chemical and biological gases and particulates as well as radioactive gases and particulates, and the like.

Table 1 provides a list of Biological and Chemical Contagions and Nuclear fallout in gas and/or various particulate form that can be prevented from passing into the novel enclosure.

TABLE 1

Airborne Chemical and Biological Agents and Radioactive particles

| Chemical Agents | Biological Agents | Nuclear fallout |
|---|---|---|
| nerve gas | anthrax | radioactive |
| mustard gas | smallpox | particles(≧0.3 micron) |
| serin | polio | |
| cyanide | bacteria | |
| Hydrogen Sulfide | viruses | |
| Sulfur Dioxide | fungi | |
| Nitrogen Dioxide. | SARS(Sudden Acute Respiratory Syndrome) | |

The novel multi-layer sheet material used in the subject invention enclosure 100 can be sized to have a thickness of approximately 4 to approximately 12 mils thick (preferably approximately 6 to approximately 8 mils thick), and be impervious to various biological and chemical airborne agents. The agents can be in the form of gases and particulates.

Figure 3:
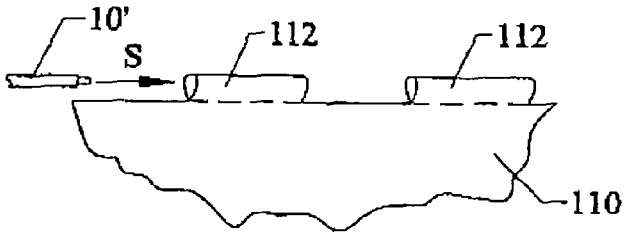
FIG. 3 shows an enlarged view of sliding the assembled poles into raised sleeves of the dome shaped material.

When taken from a storage container 20 as shown in FIG. 1, the folded enclosure 100 is unfolded, and is raised into a dome configuration by placing two assembled poles (10', 15') each through raised sleeves 112 that are preformed by stitching and the like, on side wall panels 110 of the enclosure 100 as shown by the pole 10' being inserted in the direction of arrow S into raised sleeves 112 on enclosure wall 110 shown in FIG. 3. A single person can fish a single long pole 10' into the raised sleeves 112. The pre-existing dome configuration shape forces the poles 10', 15' to flex which together creates the assembled dome configuration 100'. End tips 11 and 16 on each of the poles 10', 15' can extend downward beneath the floor portion 120 of the assembled enclosure 100'.

Figure 4:
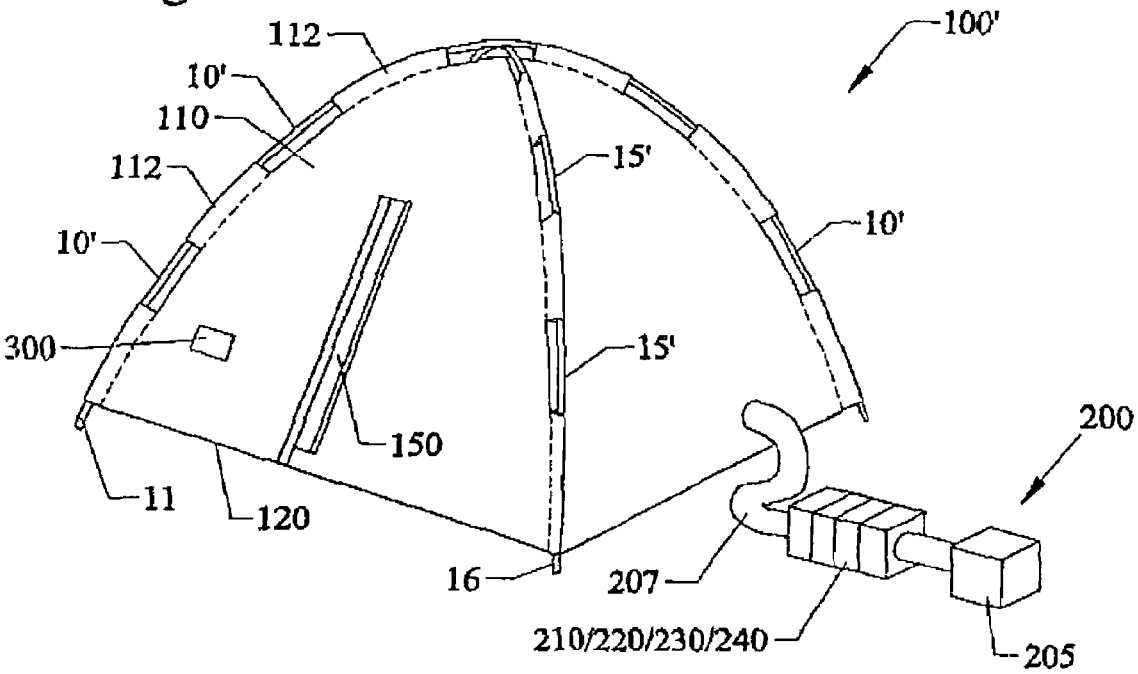
FIG. 4 shows an assembled tent enclosure with the two cross configured poles supporting an expanded dome shaped enclosure configuration.

FIG. 4 shows an assembled tent enclosure with the two cross configured poles 10', 15' supporting an expanded dome shaped enclosure configuration 100'. The dome configuration 100' with floor portion 120 when assembled with support rods 10' and 15' can measure approximately six feet by approximately nine feet wide by approximately seven feet high. Other versions of the dome shape can include approximately nine by approximately nine feet by approximately seven feet high. Another version can be approximately ten feet by approximately 18 feet wide, and approximately seven feet high.

The preferred embodiment of the assembled enclosure 100' can include a zipper arrangement 150 along one outer wall. The zipper 150 is preferably an air tight and watertight fastener such as those used by divers and with body bags, and can be of multi-layer configuration and be similarly formed with the multi-layer material previously described. The zipper 150 can be attached to the enclosure walls by the RF welding technique previously described and/or by being sewn, and the like, thereon. Examples of such zippers can include but are not limited to those shown and described in reference to U.S. Pat. Nos: 4,099,656 to Neumann et al, and 4,641,400 to Morelan, each incorporated by reference. Alternatively, the invention can use other types of watertight and air tight fasteners that can include multi-layer hook and loop fasteners, snap fasteners and the like, that must also be able to seal a positive air pressure inside of the enclosure.

Figure 5:
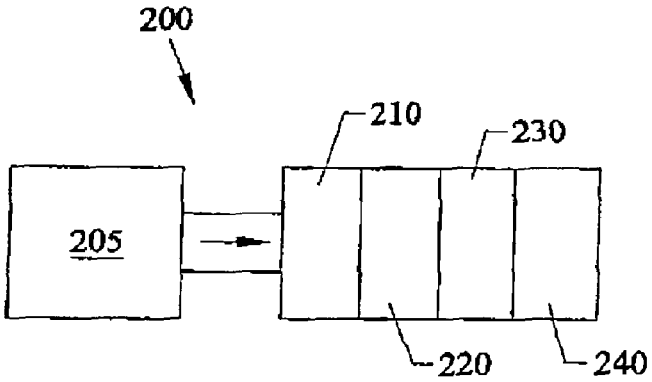
FIG. 5 is an enlarged view of the four stage multi-filter system that can be used with the preceding embodiment.

FIG. 5 is an enlarged view of the four stage multi-filter system 200 that can be used with the preceding embodiment. Referring to FIGS. 4 and 5, the enclosure 100' can have an external blower 205 such as an electrically operated fan motor that can blow up to approximately 105 cubic feet of air or more into the interior of the enclosure 100' through a multi-stage filtering system 210/220/230/240. The multi-stage air filters can clean contaminated air outside of the enclosure to create a clean air supply for occupants inside of the enclosure.

The multi-stages can include a carbon filter, a HEPA filter, an anti-microbial filter and an electric filter. The carbon filter can be a carbon-filter-nuclear rated activated carbon bed cell which can absorb virtually all gases and odors that pass through. Adsorption in the process by which activated carbon captures gases and odors, such as ones used for military gas masks, and the like. The HEPA (High Efficiency Particulate Air) filter can be rated to capture approximately 99.99% of radioactive particles as small as approximately 0.3 microns from entering into the enclosure. The anti-microbial filter captures and kills airborne microbes by using a UV light source in various selected nanometer ranges for killing off microbes, and the like. The electric filter can be an electrostatic filter, a high voltage filter, and/or an electric type filter, such as the one shown and described in reference to U.S. Pat. No. 4,185,972 to Nitta et al, which is incorporated by reference. The various filters can be connected together so that external air is purified by being passed through each filter stage.

The blower motor 205 can also be used for providing a positive pressure inside the tent when it is occupied, which also helps keep undesirable chemical, biological and radioactive agents, particulates, and gases from entering into the enclosure.

A multi-stage filtration (270) and blower 265 located outside and attached to the enclosure through a single plastic duct can also be used for releasing air from the enclosure for quarantine purposes. A second filter system 260 (FIG. 6) with blower 265 located and connected outside of the enclosure through another single duct can also be used for forming a negative pressure to filter air coming out of the enclosure.

A release valve 300 FIG. 4 can be used to release excess pressure inside of the enclosure 100', and can release at selected pressure ranges such as but not limited to approximately one pound per square inch, and the like.

In addition, the invention can also use the blower to make the tent enclosure self inflating, to that the pole supports do not always have to be used to expand the enclosure into a working assembled state.

Figure 6:
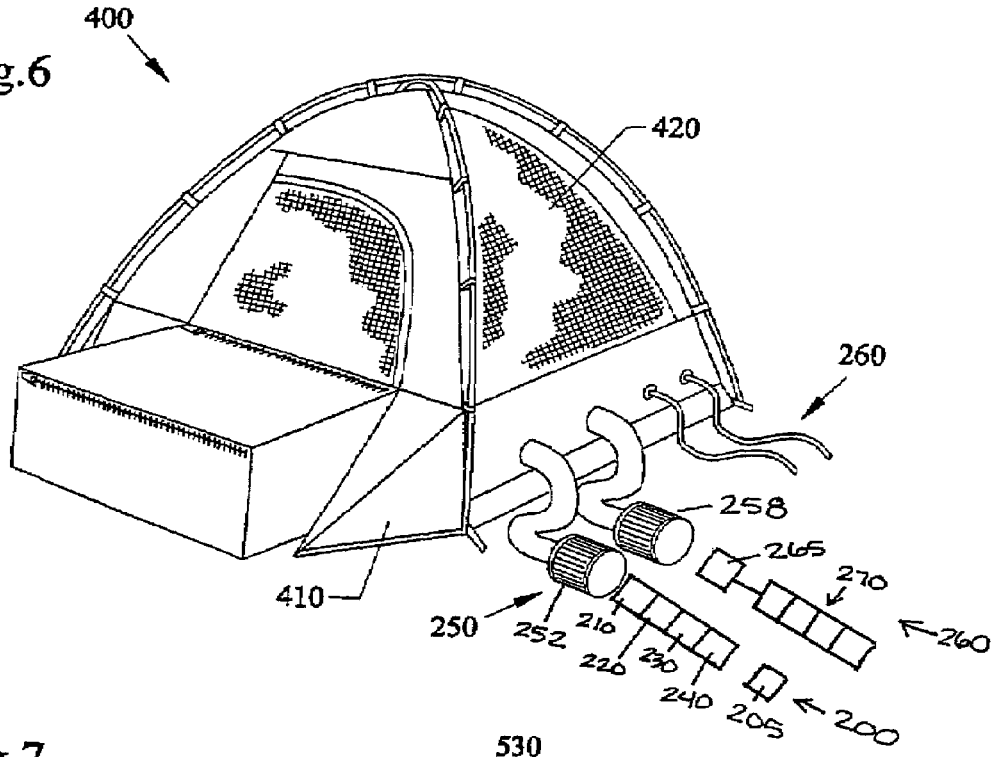
FIG. 6 is another embodiment of the enclosure.

FIG. 6 is another embodiment of the enclosure 400. An extra rectangular portal entrance 410 can be used to create more interior room inside of the enclosure 400. Additionally, the enclosure 400 can be provided with windows 420 formed from similar material to that previously described so that part of the external walls of the enclosure can be opaque, and/or colored and the like, while the windows 420 allow for translucent and transparent portions for the enclosure 400. The invention can also substitute single stage air filtering instead of multi-stage. For example, air filter canisters 250 such as those used with hazardous material suits, and the like, can instead be connected to the blower 205 previously described to pass air into the enclosure 400. Air filter canister 252 can be used in place of the multi-filter system 200 with external positive air pressure forming blower 205 that blows filtered air into the enclosure 400 as described in reference to FIGS. 4-5. Second air filter canister 258 can be used in place of second multi-filter system 260 having negative forming blower 265 and multi-filters 270 which can include similar filters to those of filters 210-240 previously described. Air filter canister 252 and first multi-filter system 200 can be piped into the enclosure through a first plastic duct such as duct 207 of FIG. 4 or duct 685 of FIG. 8. Second air filter canister 258 and second multi-filter system 260 can also be piped into the enclosure through a second plastic duct such as the duct 207 of FIG. 4 or duct 685 or FIG. 8. Extra lines 260 such as cable connections for power, telephone, and the like, can be used to supply power from various power sources, such as but not limited to 120 volt, rechargeable battery supplies and solar sources to provide power to equipment 500 inside of the enclosure.

Figure 7:
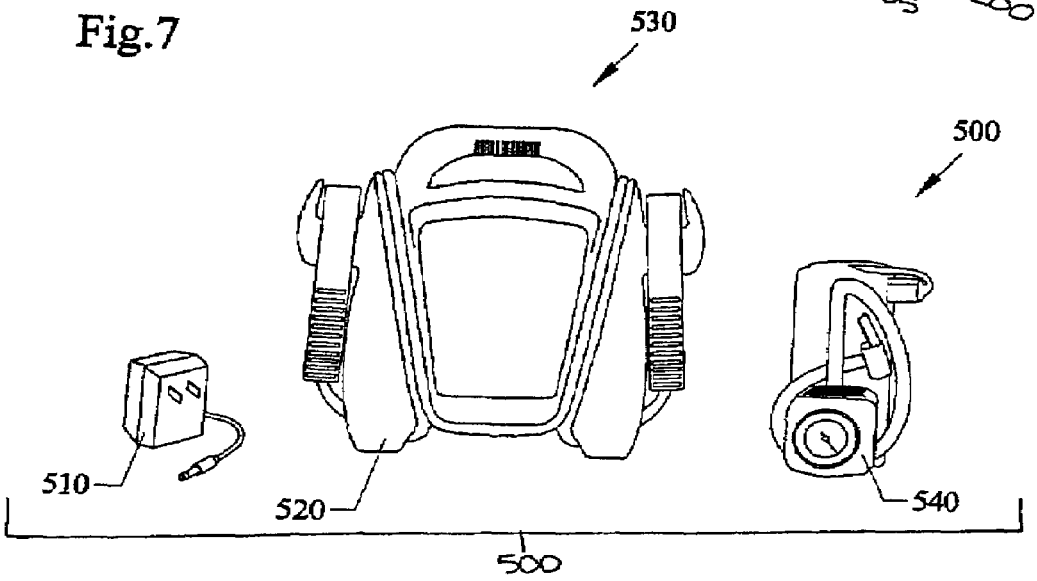
FIG. 7 shows equipment that can be used inside of the enclosure invention.

FIG. 7 shows equipment 500 that can be used inside of the enclosure invention. The equipment 500 can include but is not limited to 12 volt chargers 510, heavy duty safety clamps 520, AM/FM radios, 120 volt DC outlet 530, LED battery status indicator, and a 250 psi 12 volt air compressor 540 can be used.

The subject invention tent enclosures were tested in environments where various noxious gases were present outside of the novel tent enclosures, and readings were taken inside a closed tent enclosure of the invention. Table 2 compares OSHA (Occupational Safety and Health Act) PEL (Permissible Exposure Level) standards for the amount of exposure level that is considered acceptable for various noxious gases such as Hydrogen Sulfide, Sulfur Dioxide and Nitrogen Dioxide.

TABLE 2

| Noxious Gas | OSHA PEL (PPM) | Test Results: Ave. Exposure Level (PPM) | Test Results: Ave. Level BIODOME (PPM) |
|---|---|---|---|
| Hydrogen Sulfide | 20 | 25.795 | 1.964 |
| Sulfur Dioxide | 5 | 5.085 | 0.293 |
| Nitrogen Dioxide | 5 | 5.422 | 0.771 |

PEL refers to Permissible Exposure Level, and PPM refers to part per million.

From Table 2, it is clear that the invention tent enclosure surpasses OSHA standards for Noxious Gases and Particulate Elimination.

Following these tests, the invention tent enclosures were subjected to over four (4) times the OSHA PEL (permissible exposure level) limits for Nitrogen Dioxide, while the concentration level inside the novel tent enclosure was verified to remain below the OSHA PEL level listed in Table 2. For these tests the novel tent enclosure was subjected to noxious gases for a twenty four (24) hour duration.

The novel enclosures can allow for a comfortable level of freedom of movement and activity such as reading, watching TV or listening to the radio, playing with cards or other small group games, etc. The invention can provide a level of protection comparable to donning hazmat crew suits but without the physical (and mental) encumbrances.

For outdoor use, an additional silvered covering draped over the clear plastic sealed enclosure (like aluminum foil) could provide solar thermal and similar radiation protection. In colder climates, lightweight thermal blankets (aluminum foil clad cloth) may also be appropriate.

When being ready for use, the inventors recommend that users of the enclosures have an adequate supply of fresh, bottled water be supplied inside the dome enclosure shelter (approximately 3 liters per person per day), nutritional snacks, a porta-potty, an inflatable bed, an inflatable floor covering, inflatable chairs, and a host of battery powered appliances such as a multi-band radio, small TV, portable audio recorder, laptop computer if available, a 9-watt fluorescent lamp, an air circulating fan, an air compressor, and a cellular phone. A manual billows pump would be handy in order to assure an adequate supply of fresh air drawn in through the filter/masks units. The use of a small air purifier with room air ion production, ultra-violet radiation, and ozone generation would be most effective.

Other items can include but are not limited to a first aid kit, small fire extinguisher, necessary medications, braces, bandages, dental care kit, and a hunting knife (and perhaps a self-defense weapon), compass, watch, notepad, pencils or pens, book or magazines. A fully-charged 12-volt automotive booster battery (perhaps with a solid-state inverter) would operate appliances for many hours, even blenders or massagers. Inflatable furniture would store compactly and provide comfort for occupants sitting or sleeping.

The novel invention can be used as an isolation chamber designed for temporary emergency habitation during, for example, a chemical warfare attack of several hours duration, its family and friends occupants will be protected from the most serious harmful and life-threatening effects.

The invention allows for a low cost, affordable by a majority of families, this form of protection can be made available, with various options providing for an additional level of comfort.

The novel enclosure is a novel family protective shelter which can be erected quickly inside a home living room, family room, patio, or on an outside lawn area. This dome tent enclosure is designed of clear plastic sheet material which is impervious to gasses used to conduct chemical warfare (such as anthrax, smallpox, polio, bacteria, viruses, or fungi, or other atmospheric toxins). This protective "pop-up", external frame enclosure will be sized to house two to six adults comfortably (6'×9'×7' high inside, up to about 10'×18'×7' high), can incorporate a zip-lock entrance/egress isolation portal chamber, and will communicate to the outside world through combat gas mask filters, plus phone, computer and electrical outlet feed-through, and perhaps a water trap coupling. The object is to keep a family of 1 to 10 (with a larger size) relatively isolated and safe from the harmful effects of a chemical biohazard, or nuclear fallout enemy attack for a matter of hours up to several days. The portal chamber can be used to also connect together additional dome tent modules to accommodate more family members.

Figure 8:
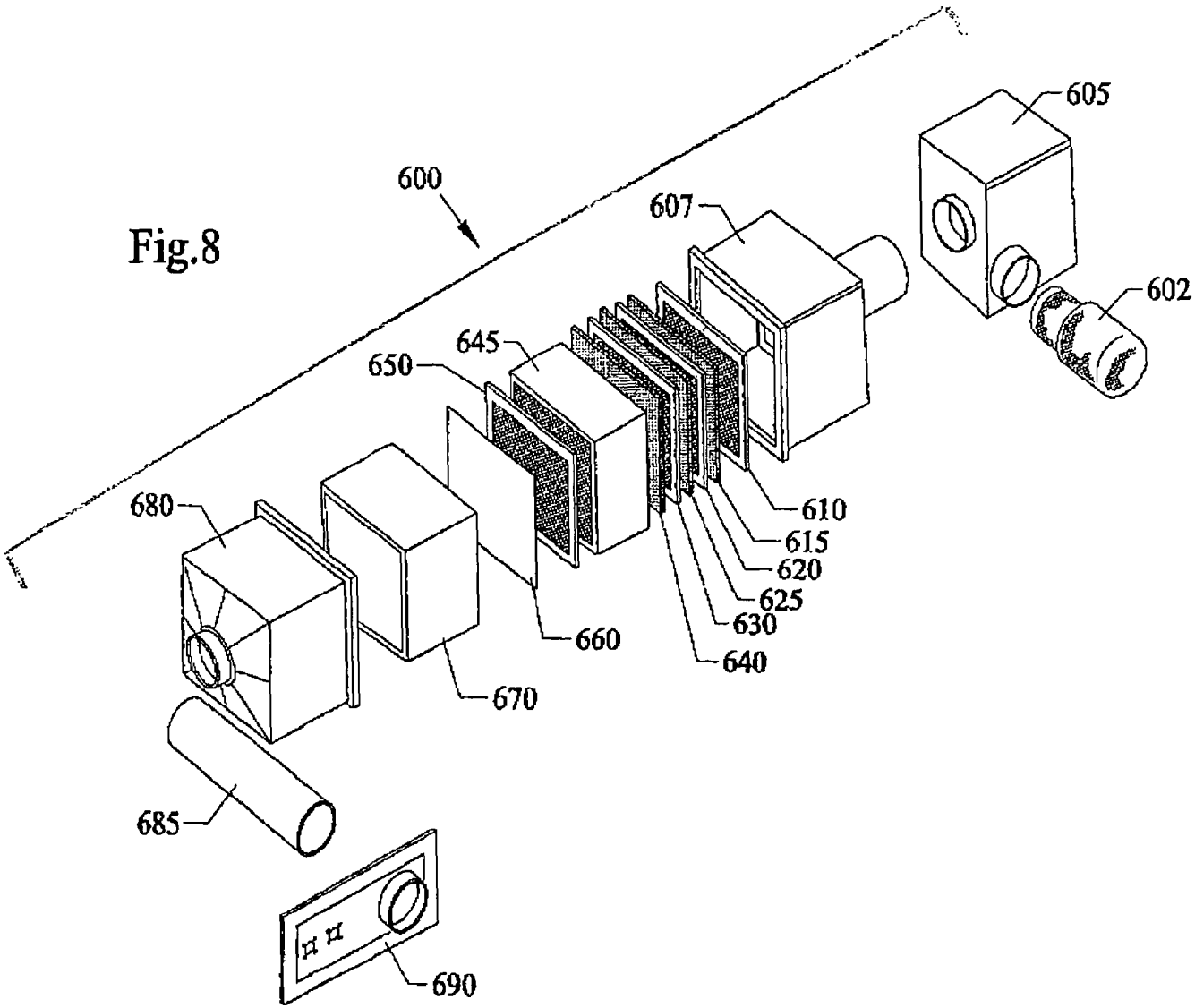
FIG. 8 is an exploded view of another embodiment of a multi-stage filter system that can be used with the invention.

FIG. 8 is another version of a multi-stage filter system 600 that can be used with the invention. The invention can use a composite filter system with a pop-up domed tent structure of gas impervious plastic which can be erected in about two minutes by two people and serves as a sealed controlled environmental chamber for temporary living quarters, thus avoiding contamination, and subsequent risk from disease or death, from the outside world.

The battery-powered blower assembly 605 with inlet air port screen 602 powered by, a sealed-motor boat engine compartment squirrel-cage exhaust fan, can be inserted at this housing portion 607. Next follows a multi-layer expanded metal screen filter 610, a polyurethane open-cell foam filter 615, a permanent electric electrostatic grid filter 620, a separating urethane foam filter 625, a matching electrostatic grid 630, a foam filter separator 640, a silver activated granulated charcoal filter assembly 645, an additional expanded metal screen 650, to keep the charcoal filter compacted, a microbial treated pleated fiber filter 660, and finally a certified HEPA filter 670 can be used to complete the composite filter assembly. A three-inch or greater plastic duct 680, 685 then directs the air flow into the environmental enclosure 100', 400 previously shown and described.

It is also possible to position the blower motor-fan assembly at this end, which would allow the air to be drawn through the filter composite and forced into the tent, as opposed to forcing the air under pressure through the whole modular filter system. Note also that this total configuration is designed to be placed outside the enclosure and also protects against the effects of rain.

The feed-through plate 690 at the lower left of FIG. 8 allows not only sealed air passage but also sealed electrical and telephone connections. A manual billows pump can also be supplied with this system in event of total electrical (battery plus line) failure. A Peltier or other small air conditioning cooling or heating module can also be added on either end of the filter coupling system for added comfort.

The whole-house unit can also incorporate the additional features of a high-voltage electrostatic stage, an ultraviolet exposure lamp, a small amount of ozone generation, as well as a negative ion generator at the exit end in order to ensure total molecular disintegration of all chemical and bio-hazardous substances and provide a positive mood enhancement. An Oxygen concentration monitor is also recommended, along with alarm detectors for excess Carbon Monoxide, Carbon Dioxide, and other important constituents.

Although a dome configuration is shown, the invention can include other shapes, such as but not limited to rectangular, square, hexagon, triangular, and the like.

The invention can have utility in various applications ranging from military and public safety to health care, and the like. In addition to family and personal safety the invention can be used for medical isolation, burn victims, and anywhere that clean air isolation is needed.

For example, the invention can be used for housing SARS (Severe Acute Respiratory Syndrome) patients, and anyone that has been exposed to any contagious elements.

Additionally, the invention can be used downwind of natural disasters such as near forest fires, and the like. Carbon noxious fumes can be prevented from entering and affecting occupants inside of the novel tent enclosure.

The novel tent enclosure invention can be sized for two men, five men, six men, and ten men occupants, as well as for other numbers of occupants.

The novel invention can be used to clean breathing air to protect personnel subject to terrorist or accidental chemical, biological nuclear fallout, smoke, allergenic agents, or other hazardous atmospheric pollutants.

A household version could aid many people who suffer respiratory problems or who suffer from contagious diseases, or who require isolation from the normal environment or who require a controlled environment for any reason.

Since we as a nation, have already suffered from enemy terrorist attacks on our own soil on Sep. 11, 2001 in New York City and in Washington, D.C., we realize the hard fact that we are vulnerable to future unwanted threats on our lives. It is the family unit that has built this nation and has given the United States it strength . . . and must be protected. Planning for survival in biohazard and chemical warfare emergencies makes sense in view of the many instances around the world where such attacks have led to suffering and casualties. Even now, we are at war in foreign combat zones, where "at home" retaliation is threatened by demented suicide bombers and murderers. Field combat troops in small units also need this type of protection with portability, quick set-up and air filtration against gas-attacks.

With a properly constructed isolation chamber designed for temporary emergency habitation during, for example, a chemical warfare attack of several hours duration, its family and friends occupants will be protected from the most serious harmful and life-threatening effects by breathing filtered and purified air using the blower and multi-stage filtration system described in this document.

The invention allows for a low cost form of protection having various options for additional levels of comfort. Not only is this system applicable with the protective enclosure, but this aid filtration system can easily be sealed up in size, utilizing the same types of multi-stage components to protect the inhabitants and contents of an entire household, provided that air leakage and circulation paths are identified and controlled.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A portable tent enclosure for protection of inhabitants inside of the tent enclosure against biological and chemical airborne agents and nuclear fallout, and for filtering out contaminated air from exiting the structure, consisting essentially of:

a collapsible frame formed from bendable poles arranged in a cross-configuration to one another;

a dome shaped enclosure consisting of walls and a floor that are solely formed from a flexible and foldable multi-layer sheet material, the flexible and foldable multi-layer sheet material having a thickness between approximately 4 to approximately 12 mils thick, said multi-layer sheet material having a plurality of sleeve portions, wherein the poles are fit within the sleeve portions on the multi-layer sheet material, the dome shaped enclosure is only supported by the bendable poles of the frame, the flexible and foldable multi-layer sheet material being water and air tight and impervious to biological and chemical airborne agents, wherein the dome shaped enclosure when assembled protects and seals occupants from the biological and chemical airborne agents and nuclear fallout;

a sealable ingress portal having multi-layer fasteners through one of the walls of the enclosure, the multi-layer fasteners being airtight and water tight in a closed position; and a first multi-stage air filter system entirely located outside and spaced from the dome shaped enclosure is directly connected to the enclosure through a first single plastic duct, the first multi-stage air filter includes:

a positive pressure input blower for blowing air into the enclosure through the first single plastic duct, and for continuously providing and maintaining a positive pressure inside the enclosure that does not leak out from both the flexible and foldable multi-layer sheet material, and from the multi-layer fasteners in the sealable ingress portal;

a first filter for absorbing odors entering the enclosure;

a second filter for capturing radioactive sized particles from entering the enclosure;

a third filter for killing microbes from entering the enclosure, the third filter includes an ultraviolet light source for killing the microbes, wherein the first multi-stage air filter system cleans contaminated air from entering into the enclosure; and a second multi-stage air filter system entirely located outside and spaced from the dome shaped enclosure is directly connected to the enclosure through a second single plastic duct, the second multi-stage air filter system includes:

a negative pressure output exhaust blower for forming a negative pressure inside the enclosure, and for filtering out contaminated air from passing outside of the enclosure;

a fourth filter for absorbing odors exiting the enclosure;

a fifth filter for capturing substantially all radioactive sized particles from exiting the enclosure; and a sixth filter for killing microbes from exiting the enclosure, the sixth filter includes a UV (ultraviolet) light source for killing the microbes, wherein the second multi-stage air filter system is for filtering out contaminated air through the fourth filter, the fifth filter and the sixth filter, in order to prevent the contaminated air from being exhausted out of the enclosure.

2. The enclosure of claim 1, wherein each of the poles includes: telescoping rods.

3. The enclosure of claim 1, further comprising:

an adjustable release valve attached to the enclosure for venting and releasing selected excess air pressure of approximately one pound per square inch from the enclosure.

4. The enclosure of claim 1, wherein the second filter and fifth filter each includes:

a filter that filters out the radioactive sized particles of at least approximately 0.3 microns in size.

5. The enclosure of claim 1, further comprising:

an assembled size of at least approximately six feet by approximately nine feet wide by approximately seven feet high in order to hold at least two occupants.

6. The enclosure of claim 1, wherein the multi-layer fasteners in the sealable ingress portal includes:

a watertight and airtight zipper fastener along an opening on at least one outer wall of the enclosure, the zipper fastener for opening and sealing the enclosure.

7. The enclosure of claim 1, further comprising: an input electrostatic filter that is electrostatically charged for filtering out additional particles from entering the enclosure, and an output electrostatic filter that is electrostatically charged for filtering out other particles from exiting the enclosure.

8. The enclosure of claim 1, wherein the flexible and foldable multi-layer sheet material having a thickness between approximately 6 to approximately 8 mils thick.

9. The enclosure of claim 1, wherein the first single plastic duct of the first multi-stage air filter system, and the second single plastic duct of the second multi-stage air filter system each include a diameter of at least approximately 3 inches in diameter.

10. The enclosure of claim 1, further comprising:

external power supplies located outside of and spaced apart from the enclosure for supplying power to equipment inside of the enclosure through cable lines that run through the walls of the enclosure, the external power supplies being solely selected from the group consisting of solar power and rechargeable batteries.

11. The enclosure of claim 1, wherein the positive pressure input blower and the first filter and the second filter and the third filter are in series with one another, with the positive pressure input blower between the first filter and the dome shaped enclosure, and the negative pressure output blower and the fourth filter and the fifth filter and the sixth filter are in series with one another, the negative pressure output blower being spaced apart from the dome shaped enclosure by the fourth, the fifth and the sixth filters.

12. The enclosure of claim 1, each layer in the multi-layer sheet material being sealed to one another by radio frequency welding.

13. A portable tent enclosure for protection of inhabitants inside of the tent enclosure against biological and chemical airborne agents and nuclear fallout, and for filtering out contaminated air to outside the structure, consisting essentially of:

a collapsible frame formed from bendable poles arranged in a cross-configuration to one another;

a dome shaped enclosure consisting of walls and a floor that are solely formed from a flexible and foldable multi-layer sheet material, the flexible and foldable multi-layer sheet material having a thickness between approximately 6 to approximately 8 mils thick, said multi-layer sheet material having a plurality of sleeve portions, wherein the poles are fit within the sleeve portions on the multi-layer sheet material, the dome shaped enclosure that is solely supported by the bendable poles of the frame, the flexible and foldable multi-layer sheet material being water and air tight and impervious to biological and chemical airborne agents, each layer in the multi-layer sheet material being sealed to one another by radio frequency welding, wherein the dome shaped enclosure when assembled has dimensions of at least approximately six feet by approximately nine feet wide by approximately seven feet high in order to hold at least two occupants, and to protect and seal the occupants from the biological and chemical airborne agents and nuclear fallout;

a sealable ingress portal having multi-layer zipper fasteners through one of the walls of the enclosure, the multi-layer zipper fasteners being airtight and water tight in a closed position, each layer in the multi-layer fasteners being sealed to one another by radio frequency welding;

a first multi-stage air filter system entirely located outside and spaced apart from the dome shaped enclosure and directly connected to the enclosure solely through a first single plastic duct having a diameter of at least approximately 3 inches, the first multi-stage air filter includes:

a positive pressure input blower for blowing air into the enclosure and for providing and continuously maintaining a positive pressure inside the enclosure through the first single plastic duct, where the positive pressure does not leak out from both the flexible and foldable multi-layer sheet material, and from the multi-layer fasteners in the sealable ingress portal;

a first filter in series with the positive pressure input blower, for absorbing odors entering the enclosure;

a second filter in series with the second filter, for capturing radioactive sized particles of at least approximately 0.3 microns in size from entering the enclosure;

a third filter in series with the second filter, having an ultraviolet light source for killing microbes from entering the enclosure, wherein the multi-stage air filter system cleans contaminated air from entering into the enclosure;

a fourth filter in series with the third filter, that is electrostatically charged for filtering out additional particles from entering the enclosure, with the positive pressure input blower between the first filter and the dome shaped enclosure and a second multi-stage air filter system entirely located outside and spaced apart from the dome shaped enclosure, and being directly connected to the enclosure solely through a second single plastic duct having a diameter of at least approximately three inches, the second single plastic duct being different from and separate from the first single plastic duct, the second multi-stage air filter system includes:

a negative pressure output exhaust blower separate from the positive pressure output exhaust blower, for forming a negative pressure inside the enclosure through the second single plastic duct, and for filtering out contaminated air from exiting outside of the enclosure;

a fifth filter in series with the negative pressure output exhaust blower, for absorbing odors exiting the enclosure;

a sixth filter in series with the fifth filter, for capturing radioactive sized particles of at least approximately 0.3 microns in size from exiting the enclosure; and a seventh filter in series with the sixth filter, for killing microbes from exiting the enclosure;

an eighth filter in series with the seventh filter, that is electrostatically charged for filtering out additional particles from exiting the enclosure, wherein the second multi-stage air filter system is for filtering out contaminated air through the fifth filter, the sixth filter and the seventh filter and eighth filter, in order to prevent the contaminated air from being exhausted out of the enclosure, the negative pressure output blower being spaced apart from the dome shaped enclosure by the fifth, the sixth, the seventh and the eighth filters;

an adjustable release valve attached to the enclosure for venting and releasing selected excess air pressure of approximately one pound per square inch from the enclosure; and external power supplies located outside of the enclosure for supplying power to equipment inside of the enclosure through cable lines that run through the walls of the enclosure, the external power supplies being solely selected from the group consisting of solar power and rechargeable batteries.

* * * * *